United States Patent [19]

Maudlin

[11] 4,208,886

[45] Jun. 24, 1980

[54] SUBCOOLING VALVE FOR SPLIT SYSTEM AIR CONDITIONING APPARATUS WITH REMOTE CONDENSING UNIT

[75] Inventor: Wendell E. Maudlin, York, Pa.

[73] Assignee: Borg-Warner Corporation, Chicago, Ill.

[21] Appl. No.: 966,428

[22] Filed: Dec. 4, 1978

[51] Int. Cl.[2] ..... F25B 1/00

[52] U.S. Cl. ..... 62/498; 62/511; 62/527

[58] Field of Search ..... 62/115, 511, 527, 498

[56] References Cited

U.S. PATENT DOCUMENTS

| | | | |
|---|---|---|---|
| 2,137,260 | 11/1938 | Boles | 62/511 |
| 2,393,854 | 1/1946 | Carpenter | 62/511 |
| 2,645,099 | 7/1953 | Cumming | 62/511 |
| 2,694,296 | 11/1954 | Prosek et al. | 62/511 |
| 3,659,433 | 5/1972 | Shaw | 62/511 |
| 3,785,163 | 1/1974 | Wagner | 62/511 |
| 3,952,533 | 4/1976 | Johnston et al. | 62/115 |

*Primary Examiner*—Ronald C. Capossela
*Attorney, Agent, or Firm*—Davis Chin

[57] ABSTRACT

An air conditioning system in which a subcooling valve is located in the liquid line fitting upstream from the evaporator creating a pressure drop ahead of the capillary tube to effect liquid subcooling of refrigerant leaving the condenser, thereby resulting in higher cooling capacity and efficiency.

4 Claims, 2 Drawing Figures

SUBCOOLING VALVE FOR SPLIT SYSTEM AIR CONDITIONING APPARATUS WITH REMOTE CONDENSING UNIT

BACKGROUND OF THE INVENTION

1. Field of the Invention

Refrigerating apparatus having means for reducing the pressure of liquid refrigerant from the condenser into the evaporator is generally classified in Class 62, Subclass 115.

2. Description of the Prior Art

In U.S. Pat. No. 2,137,260 issued to C. B. Boles on Nov. 22, 1938, there is disclosed a refrigerating apparatus which includes a fixed restrictor connected between the output of a condenser and the input of a heat exchanger, and a second restrictor coupled between the output of the heat exchanger and the input of an evaporator.

In U.S. Pat. No. 2,393,854 issued to T. E. Carpenter on Jan. 29, 1949, there is described a refrigerant expander which includes a capillary tube and a manually operable member. The operable member is connected to the outlet end of the capillary tube for adjustably throttling the pressure of the refrigerant passing into the evaporator.

In U.S. Pat. No. 2,645,099 issued to A. S. Cumming on July 14, 1953, there is described a capillary tube assembly for refrigerators in which the capillary tube is completely enclosed within an outer tube. One end of the capillary tube is connected to an evaporator inlet, and a fitting is secured to the other end of the capillary tube and is provided with a fluid flow passage therethrough communicating with the capillary tube.

SUMMARY OF THE INVENTION

This invention relates generally to split system, residential type air conditioning units in which the evaporator is mounted in a furnace plenum and the condenser and compressor are arranged so that outside ambient air can be circulated over the condenser. In the installation of this type of system, the evaporator is secured in a plenum, usually on top of the furnace heat exchanger, in the path of air circulated throughout the enclosed space. The condensing unit, which includes the compressor, the condenser and the condenser fan assembly is usually anchored to a fixed pad outside the residence. The two units are then connected by:

1. A liquid line running from the condenser outlet to the expansion device, usually a capillary tube; and
2. A field installed suction line running from the evaporator outlet to the suction side of the compressor.

Most manufacturers of this type of apparatus offer a variety of different sized condensers and evaporators. Within limits, it is possible to construct an efficient system with a slight mismatch between the condenser and the evaporator. For example, if it is necessary to replace the condensing unit, it is possible to do so with a unit which is not exactly sized to the evaporator already in place. This allows the homeowner to use the evaporator coil already in place. This procedure does, however, create some problems in that the capillary should be properly sized to correct the mismatch. In order to avoid replacing or carrying a large selection of different sized capillary tubes, it is desirable to use a slightly oversized capillary tube and install, immediately upstream from such tube, a device which will produce a pressure drop. This pressure drop, added to the pressure drop across the capillary tube, results in an optimum overall pressure drop.

The present invention is directed to a spring biased valve installed immediately upstream from the capillary tube, usually with a filter-drier element in between, to produce limited expansion of refrigerant prior to the refrigerant entering the capillary tube. One advantage of the present device is that the capillary tube is still retained as the primary expansion device which need not be critically dimensioned. This results in more stable control. In addition, the system is less prone to blockage with foreign material due to a larger port diameter. In the event of blockage, the valve will open further to clear itself while still providing the desired pressure drop. It is also possible to mount the filter-drier at the factory immediately ahead of the primary expansion device to obtain maximum protection against the inadvertent inclusion of foreign material. The single size unit will maintain essentially a controlled pressure drop over a wide range of refrigerant flow. It also reduces cycling losses by keeping more liquid in the high side of the system during the off-cycle when the compressor is shut down and reduces the possibility of liquid slugging upon start-up by keeping liquid out of the crankcase upon shutdown.

DESCRIPTION OF THE DRAWINGS

These and other objects of the present invention will become more fully apparent from the following detailed description when read in conjunction with the accompanying drawings wherein.

DETAILED DESCRIPTION OF THE PREFERRED EMBODIMENT

Figure 1:
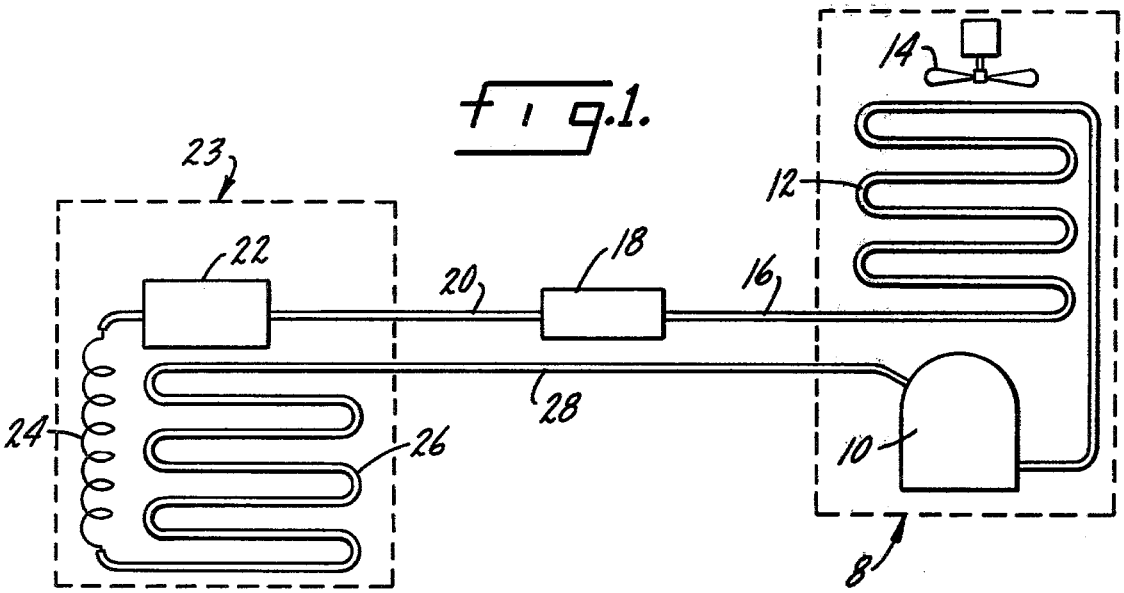
FIG. 1 is a schematic diagram of split system air conditioning apparatus utilizing a subcooling valve in accordance with the present invention.

FIG. 1 shows a typical split system air conditioning apparatus with a remote condensing unit 8. The condensing unit includes a compressor 10 which delivers refrigerant vapor at high pressure to the condenser 12 through which air circulates by means of fan 14. The condensed refrigerant flows through a field installed liquid line 16 to a subcooling valve 18. Since the valve 18 creates a pressure drop, some expansion of the refrigerant occurs at this point. The refrigerant then flows through line 20 to a filter-drier 22 in evaporator unit 23, the outlet of the filter-drier being connected to a capillary tube 24. Low pressure refrigerant then flows to evaporator 26 where it evaporates and abstracts heat from the air circulating through the evaporator and throughout the cooled enclosure unit 23. The outlet of the evaporator 26 is connected to a field installed suction line 28 which runs to the inlet side of the compressor 10.

Figure 2:
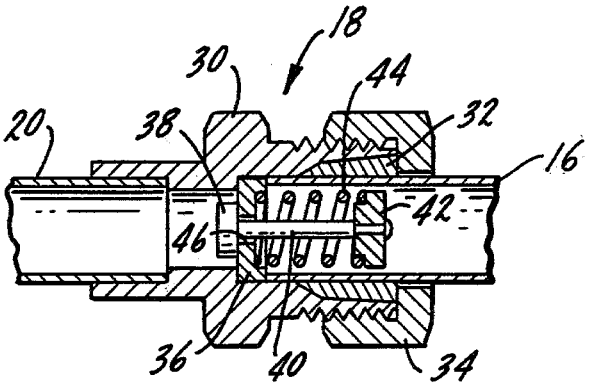
FIG. 2 is a detailed cross-section view of the subcooling valve.

As shown in FIG. 2, the subcooling valve comprises a conventional compression fitting 30 attached to line 20. A ferrule 32 cooperates with a compression nut 34 to clamp the field installed liquid line 16 to the compression fitting. Inside the liquid line is a valve assembly including an annular seat 36, a valve member 38 having an elongated stem 40, a spring retainer 42, and a spring 44 under compression which is retained between the backside of the valve seat and the retainer 42 at the end of stem 40. When the compressor 10 is in the shut down condition, the spring 44 expands to urge the valve member 38 against the seat 36 thereby closing aperture 46 so that no refrigerant flows from the condenser 12 into the capillary tube 22. This reduces cycling losses by maintaining more liquid refrigerant in the high side of the system.

In the normal operating condition during the on-cycle when the compressor is running, the pressure of the liquid refrigerant from the condenser 12 will overcome the bias of spring 44 moving the valve member 38 to the left in FIG. 2 of the drawings. This results in the opening of the aperture 46 so as to allow flow therethrough and producing a pressure drop. This pressure drop will automatically adjust the flow of liquid refrigerant for the slightly over-sized capillary tube 22 and will result in some liquid subcooling of the refrigerant leaving condenser 12.

From the foregoing detailed description, it can thus be seen that the present invention provides an improved air conditioning apparatus of the split system type having a subcooling valve for creating a pressure drop ahead of the capillary tube so that the combination supplies a desired total restriction. Further, the subcooling valve can be easily field installed into the liquid line running between the condenser and the capillary tube. In addition, the subcooling valve provides a simple and economic manner of constructing an efficient system in which there is a slight mismatch between the condenser and the evaporator.

While there has been illustrated and described what is at present to be a preferred embodiment of the present invention, it will be understood by those skilled in the art that various changes and modifications may be made and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out this invention but that the invention will include all embodiments falling within the scope of the appended claims.

What is claimed is:

1. In an air conditioning apparatus of the type including a compressor, a condenser, an evaporator, and conduit means for connecting the compressor, condenser and evaporator to form a closed system for refrigerant fluid flow, the improvement comprising:

a capillary tube connected between said condenser and said evaporator; and valve means being connected between said condenser and said capillary tube for creating a pressure drop ahead of said capillary tube and for effecting subcooling of refrigerant leaving the condenser, said valve means including a valve member resiliently biased toward a closed position against the direction of fluid flow, said valve member being in the closed position when the compressor is shut down, said valve member being opened in the normal operating condition during the on-cycle when the compressor is running so as to produce the pressure drop.

2. Air conditioning apparatus as claimed in claim 1, wherein said valve means is positioned in a field-installed refrigerant line connected between the outlet of the condenser and the inlet of said capillary tube.

3. Air conditioning apparatus as claimed in claim 1, a wherein a spring biases said valve means against a valve seat to discontinue refrigerant flow when the compressor is shut down so as to reduce cycling losses.

4. Air conditioning apparatus as claimed in claim 1, further including a filter-drier interconnected between said valve means and the inlet of said capillary tube to provide maximum protection against foreign material.

* * * * *